US005986535A

United States Patent [19]

Stiekel

[11] Patent Number: 5,986,535

[45] Date of Patent: Nov. 16, 1999

[54] LOW COST THERMOSTAT APPARATUS AND METHOD FOR CALIBRATING SAME

[75] Inventor: Jan J. Stiekel, Coevorden, Netherlands

[73] Assignee: Texas Instruments Incorporated, Dallas, Tex.

[21] Appl. No.: 09/009,609

[22] Filed: Jan. 20, 1998

[51] Int. Cl.[6] ..... H01H 37/60; H01H 37/12; H01H 71/16

[52] U.S. Cl. ..... 337/347; 337/298; 337/333; 337/343; 337/53; 337/57

[58] Field of Search ..... 337/298, 56, 318, 337/327, 329, 330, 333, 343, 347, 365, 368, 390, 392, 53, 57

[56] References Cited

U.S. PATENT DOCUMENTS

| | | | |
|---|---|---|---|
| 3,023,350 | 2/1962 | Broadley et al. . | |
| 3,263,049 | 7/1966 | Doherty, Jr. . | |
| 3,297,845 | 1/1967 | Mertler | 337/343 |
| 3,768,057 | 10/1973 | Sekira et al. | 337/349 |
| 4,101,861 | 7/1978 | Jenne . | |
| 4,339,740 | 7/1982 | Greenhalgh | 337/39 |
| 4,350,967 | 9/1982 | Doherty, Jr. | 337/343 |
| 4,528,540 | 7/1985 | Stiekel et al. . | |
| 4,554,525 | 11/1985 | Bayer | 337/356 |
| 4,622,739 | 11/1986 | Pejouhy et al. | 29/622 |
| 4,758,876 | 7/1988 | Calenda et al. . | |
| 5,181,005 | 1/1993 | Bayer | 337/354 |
| 5,270,799 | 12/1993 | Rose | 337/354 |
| 5,402,099 | 3/1995 | Ballard et al. | 337/298 |

*Primary Examiner*—Leo P. Picard
*Assistant Examiner*—Anatoly Vortman
*Attorney, Agent, or Firm*—Russell E. Baumann; Richard L. Donaldson

[57] ABSTRACT

A low cost thermostatic switch (10) has first and second scoop shaped terminal members (12, 14) having flanges (12*e*, 14*e*) received on ledges (20*f*) formed on opposed sidewalls (20*e*) of a housing (20). The terminal members are spaced apart with the distal end portions (20*g*) of the sidewalls of the housing bent over to clamp the terminal members to the housing with a strip (16) of electrical insulation placed therebetween. A movable contact arm (22, 22', 22") is cantilever mounted on the bottom wall (14*a*) of one terminal member (14) movable into and out of electrical engagement with a stationary contact (26) mounted on the bottom wall (12*a*) of the other terminal member. A motion transfer pin member (28) is adjustably mounted on the movable contact arm and extends downwardly toward a thermostatic snap-acting disc (30) received on a disc seat (20*b*) formed on the bottom wall (20*a*) of the housing with the disc adapted to transfer motion through the motion transfer pin member (28) to move the movable contact arm out of electrical engagement with the stationary contact (26) in one of the two oppositely dished configurations of the disc. A spring 32 is mounted in the housing (20) in a modified thermostatic switch (10') to maintain snap-acting disc on the disc seat (20*b*) regardless of the orientation of the switch. The switch is calibrated by adjusting the position of the motion transfer pin relative to a reference level to be within a selected gap and then deforming the sidewalls of the housing until the movable contact moves out of electrical engagement with the stationary contact (26).

12 Claims, 6 Drawing Sheets

LOW COST THERMOSTAT APPARATUS AND METHOD FOR CALIBRATING SAME

BACKGROUND OF THE INVENTION

This invention relates generally to thermostatic electrical switches and more particularly to such switches which use a snap-acting thermostatic disc to control the state of energization of an electrical circuit.

Conventional thermostatic switches typically employ an electrically insulating base of plastic, or ceramic for high temperature environments, to mount the components of the switch and provide required electrical isolation therebetween. This base is attached to a heat conductive metallic can for mounting the heat responsive disc in heat conductive relationship with a heat source to be monitored. Although this arrangement has been effective, there is a need to provide a device which is less expensive to manufacture yet one which can be easily and accurately calibrated.

SUMMARY OF THE INVENTION

It is an object of the invention to provide a thermostatic electrical switch which is less expensive to manufacture than prior art thermostats described above. Another object is the provision of a thermostatic electrical switch which is comprised of fewer components than the above noted prior art thermostats and one which is particularly adapted for mass manufacturing techniques. Yet another object of the invention is the provision of a method for calibrating the new low cost thermostatic electrical switch.

Briefly, in accordance with the invention, first and second scoop shaped terminal members are formed from a metal strip and are each provided with opposed sidewalls, one end wall and a bottom wall. The terminal members are provided with flanges which are received on ledges formed on a pair of opposed sidewalls of a thermostatic disc receiving housing with a strip of electrically insulating material disposed between the terminal members and the housing. The distal free ends of the sidewalls are bent over to clamp the flanges through the electrically insulating strip. The terminal members are spaced from one another with the open ends facing one another and a movable contact arm is cantilever mounted on the bottom wall of one terminal member with the free end of the movable contact arm biased into electrical engagement with a stationary contact on the bottom wall of the other terminal member. Tabs are provided on the flange of the terminal members which are bent over to clamp the electrically insulating strip positioning the terminal members a selected distance from one another. A motion transfer member in the form of a ceramic pin is adjustably mounted in an aperture formed in the movable contact arm and extends from the arm down toward a thermostatic snap-acting disc mounted on a disc seat formed on a bottom wall of the disc receiving housing. The disc is movable between opposite dished configurations in dependence upon selected temperature conditions and biases the movable contact arm out of electrical engagement with the stationary electrical contact through the motion transfer member in one of the dished configurations.

In a modified embodiment a spring is mounted in the disc receiving housing and engages the outer marginal portion of the snap-acting disc biasing the disc toward the disc seat to provide consistent thermal response regardless of the orientation of the thermostatic switch.

The thermostatic switch made in accordance with the invention is calibrated by first adjusting the position of the motion transfer pin to provide a gap of between 0 and 0.2 mm between the pin and a plane which lies above the disc seat a distance equal to the thickness of the disc. A spring loaded member carried by a punch is moved from a location below the thermostatic switch upwardly in a vertical direction and is brought into engagement with the bottom surface of the housing in alignment with the disc seat and a pin fixedly mounted relative to the spring loaded member is received through an aperture in the bottom wall of the housing lifting the disc off the disc seat. The punch is moved further in the same direction into engagement with an intermediate wall of the housing and with continued movement causes the sidewalls of the housing to deform. The sidewalls are preferably weakened at a selected location by providing one or more slots and further the walls are preferably pre-bent a slight amount, approximately 0.25 mm, to cause the walls to buckle in a predetermined direction, i.e., inwardly. Movement of the punch is terminated as soon as the movable contact arm moves out of electrical engagement with the stationary contact.

BRIEF DESCRIPTION OF THE DRAWINGS

Other objects, advantages and details of the novel improved thermostatic electrical switch and method for calibrating the switch of the invention appear in the following detailed description of the preferred embodiments of the invention, the detailed description referring to the drawings in which.

DETAILED DESCRIPTION OF PREFERRED EMBODIMENTS

Figure 1:
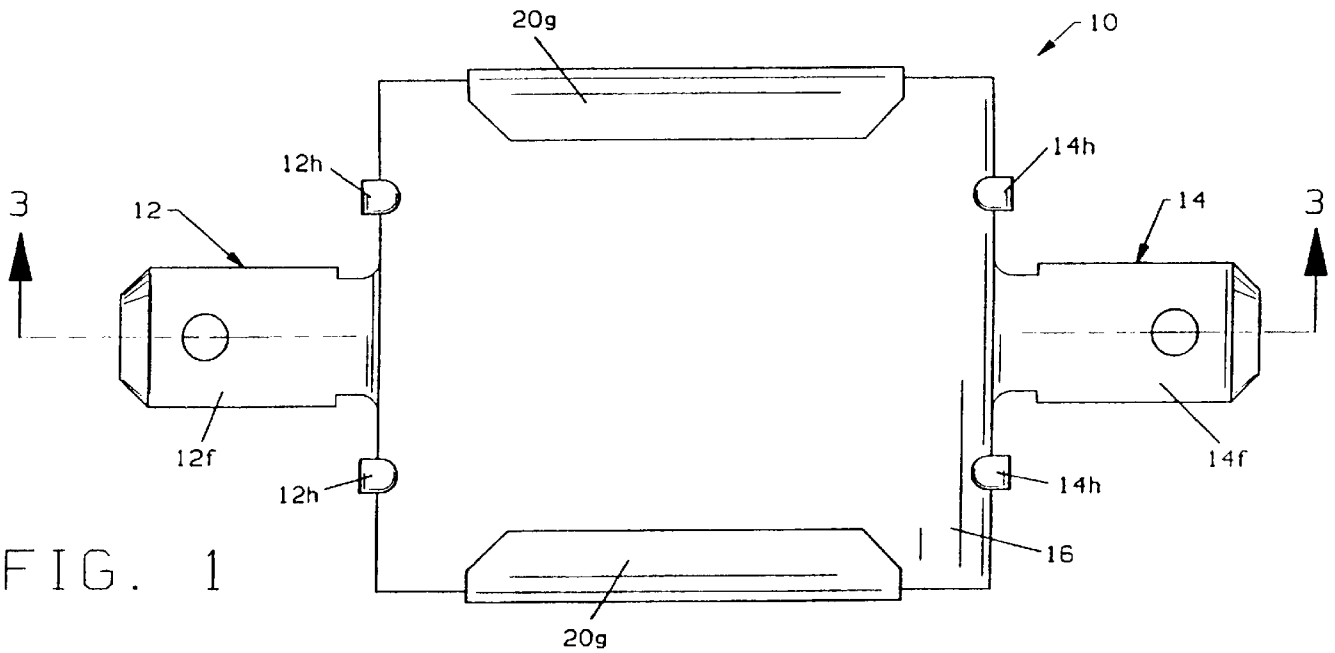
FIG. 1 is a top plan view of a thermostatic switch made in accordance with the invention.
Figure 2:
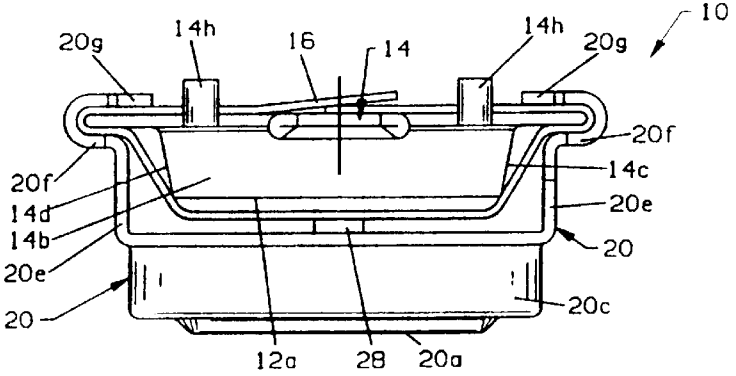
FIG. 2 is a right elevational side view of the FIG. 1 switch.

With reference to FIGS. 1–6, thermostat 10, made in accordance with the invention, comprises a switch portion and a heat sensing portion, the switch portion comprising first and second generally scoop shaped terminal members 12 and 14 respectively, each formed of suitable electrically conductive metal, such as nickel plated steel, and respectively having a bottom wall 12*a*, 14*a*, one end wall 12*b*, 14*b*, opposed first and second sidewalls 12*c*, 12*d* and 14*c*, 14*d* extending upwardly from the bottom wall and a flange 12*e*, 14*e* extending laterally outwardly from the top portion of the upwardly extending walls. A terminal portion 12*f*, 14*f* extends laterally outwardly from the flange at the respective end walls 12*b*, 14*b*. The terminals may be conveniently formed from strip by blanking and forming into the scoop shaped configuration and with the terminal portions thickened by bending the strip back onto itself as indicated at 14*g* in FIG. 6.

A strip 16 of suitable electrically insulating material such as NOMEX, a trademark of Dupont de Nemours for aramide paper is wrapped around terminal members 12 and 14. A pair of tabs 12*h*, 14*h* extending from respective flanges 12*e*, 14*e* adjacent terminal portions 12*f*, 14*f* are bent over to clampingly engage strip 16. The width of strip 16, taken in the direction from tabs 12*h* to tabs 14*h*, is selected so that terminals 12 and 14 are spaced from one another a predetermined distance 18 shown in FIG. 4. A centrally disposed aperture 16*a* is formed in strip 16 to allow a motion transfer member, to be discussed below, to pass therethrough.

Figure 6:
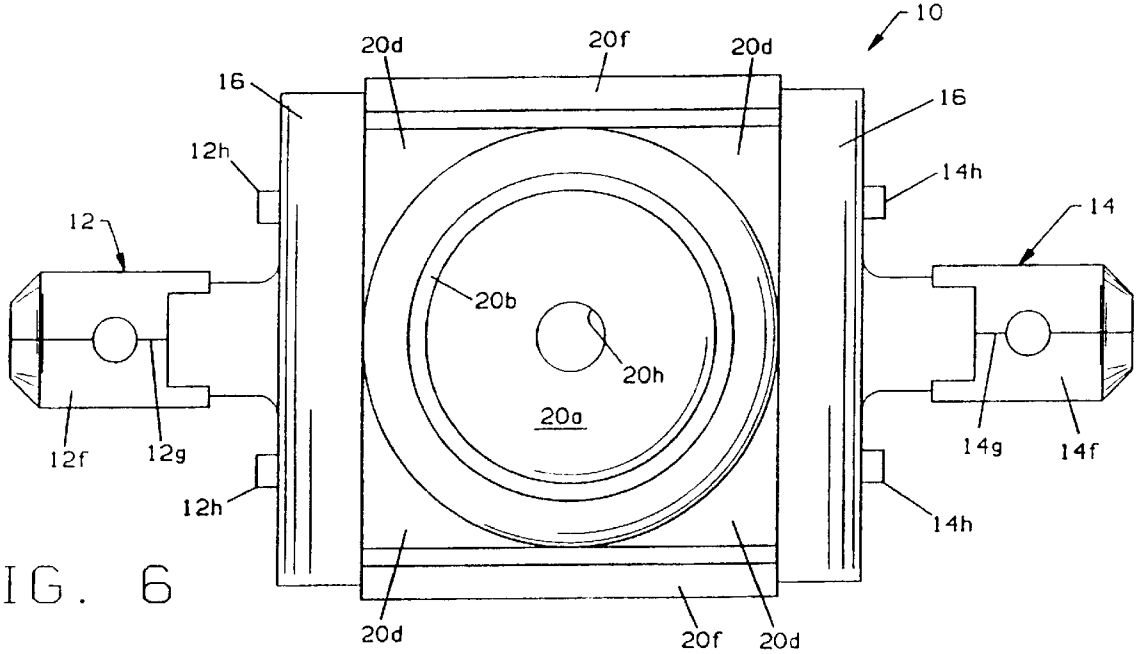
FIG. 6 is a bottom plan view of the FIG. 1 switch.

The heat sensing portion includes a thermally conductive disc receiving housing 20, formed of suitable metal such as the nickel plated steel used for terminals 12 and 14, having a bottom wall 20*a* formed with an annular disc receiving seat 20*b* and with a cylindrical wall portion 20*c* extending upwardly therefrom to an intermediate laterally extending wall 20*d* (see FIG. 6). Opposed first and second sidewalls 20*e* extend upwardly from intermediate wall 20*d* to a laterally, outwardly extending ledge 20*f*. Flanges 12*e* and 14*e* of terminals 12 and 14 respectively, along with insulating strip 16, are received on ledges 20*f* of housing 20 with distal free ends 20*g* of sidewalls 20*e* bent over to clampingly engage flanges 12*e*, 14*e* through insulating strip 16.

Figure 5:
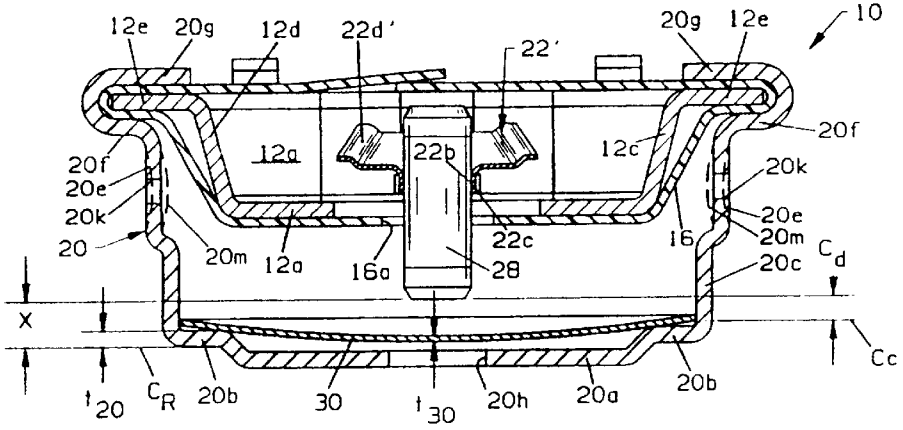
FIG. 5 is a cross sectional view taken on line 5—5 of FIG. 3.

A movable contact arm 22 formed of suitable electrically conductive material having good spring characteristics, such as beryllium copper, is cantilevered mounted on bottom wall 14*a*, as by welding at 22*a*, and has a movable electrical contact 24 attached to an opposite free end of arm 22, as by welding. An aperture 22*b* is formed through arm 22 at a generally central location intermediate to its fixed and free ends and is formed with a skirt 22*c* which frictionally engages a ceramic pin 28 which serves as a motion transfer member. Pin 28 is preferably a cylindrical member and can be positioned within skirt 22*c* and retained there by the frictional engagement of skirt 22*c* but can be adjusted to a selected longitudinal position by use of a force level greater than that to which the pin will be subjected during operation of the thermostat. Pin 28, mounted in aperture 22*b*, extends downwardly toward bottom wall 20*a* of disc receiving housing 20 so that it is positioned closely adjacent a disc, to be discussed below, mounted on seat 22*b* of bottom wall 20*a*. Opposed sides 22*d* of arm 22 shown in FIG. 4 or modified 22*d'* in FIG. 5 are bent out of the plane of the arm in order to stiffen the arm except at a flexible portion adjacent to the cantilever mounted end. Arm 22 is movable toward and away from a stationary electrical contact 26 fixedly mounted on bottom wall 12*a* of terminal member 12 and is pre-biased toward stationary contact 26.

Figure 3:
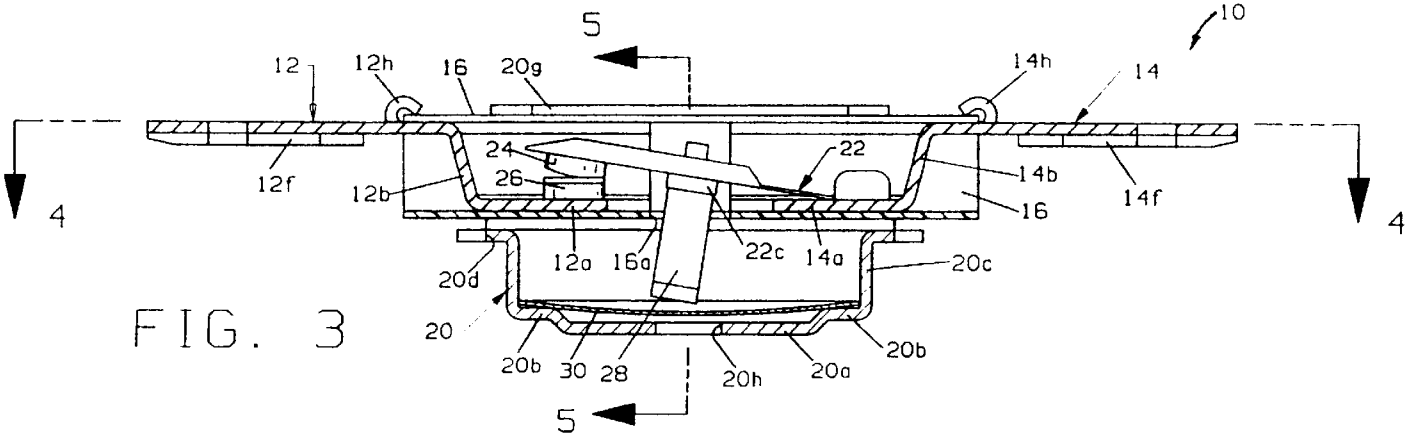
FIG. 3 is a cross sectional view taken on line 3—3 of FIG. 1.
Figure 4:
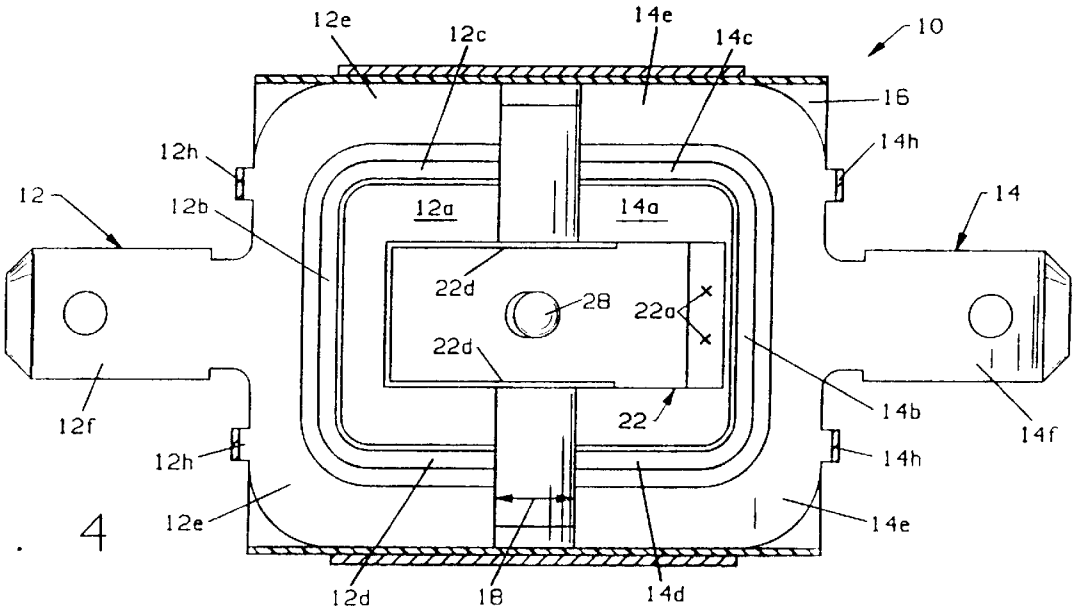
FIG. 4 is a cross sectional view taken on line 4—4 of FIG. 3.

A temperature responsive thermostatic, snap-acting disc 30 is mounted on annular disc seat 20*b* of the thermally conductive housing 20 and is adapted to move between an upwardly concave dished configuration shown in FIGS. 3 and 5 to an oppositely dished, or upwardly convex configuration (not shown) at a selected temperature.

In operation, thermostat 10 is placed in heat transfer relation with a heat source which is to be monitored. At temperatures below a selected level, contacts 24, 26 will be in engagement with one another to thereby complete an electric circuit between terminals 12 and 14. When the temperature of the heat source increases causing the temperature of snap acting disc 30 to increase to the selected level, disc 30 will snap from the configuration shown to its oppositely dished configuration thereby transferring motion through motion transfer member 28 to movable contact arm 22, 22' causing the contacts to move out of engagement and interrupt current flow between the terminals.

The design of thermostat 10 is such that it lands itself to mass production techniques. The terminals 12, 14, housing 20, insulating strip 16 and movable contact arm 22, 22' can all be formed automatically from reeled strips and assembled to provide a low cost thermostat.

Figure 7:
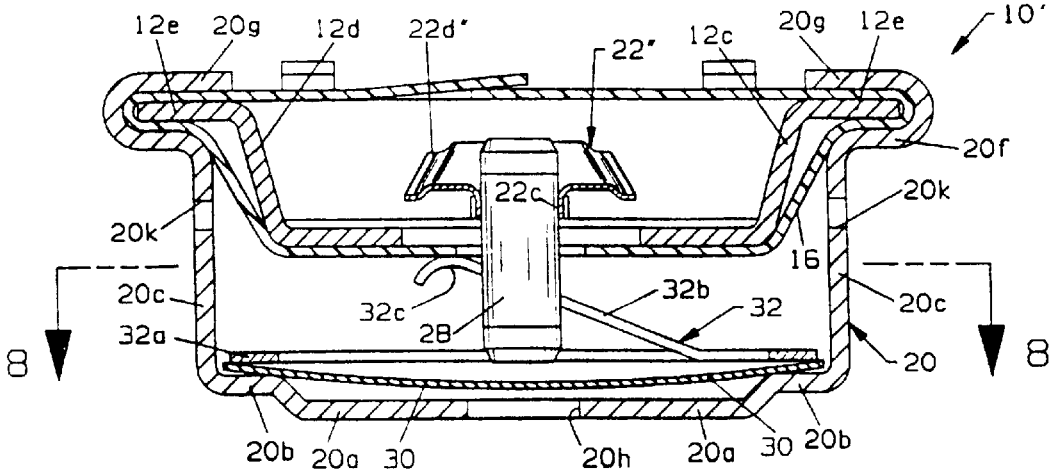
FIG. 7 is a cross sectional view similar to FIG. 5 but of a modification of the FIGS. 1–6 thermostatic switch.
Figure 8:
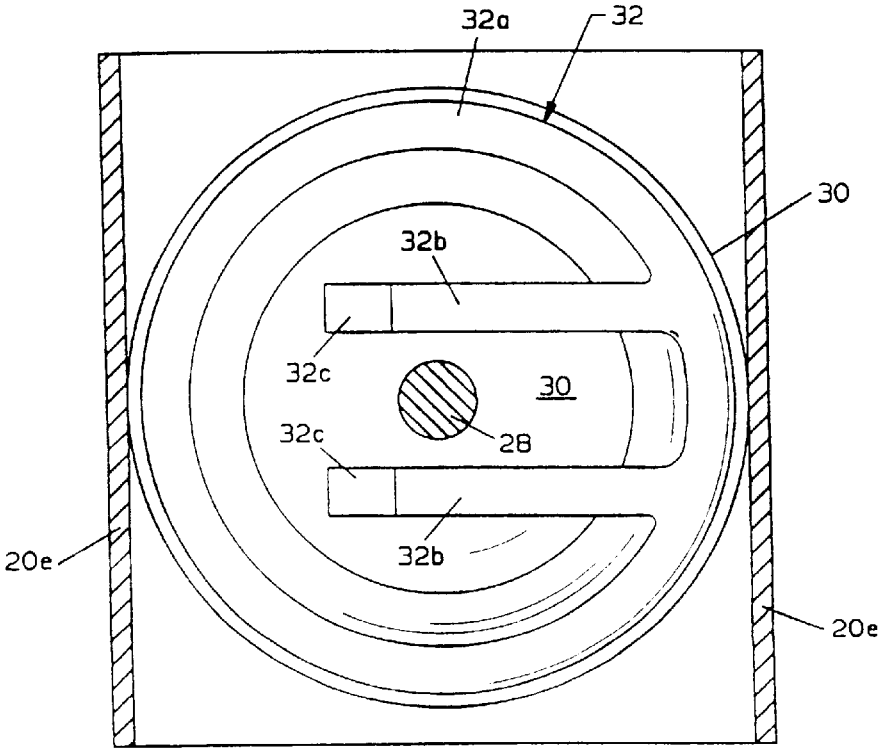
FIG. 8 is a cross sectional view taken on line 8—8 of FIG. 7.

A modified embodiment 10' of the thermostatic switch is shown in FIGS. 7 and 8 in which a spring member 32 is mounted in disc receiving housing 20 and is adapted to maintain snap-acting disc 30 on disc seat 20*b* regardless of the orientation of thermostatic switch 10'. Spring member 32, formed of any suitable material having good spring characteristics, has an annular base 32*a*, generally matching that of disc seat 20*b* but preferably with a slightly smaller outer diameter, and a pair of upwardly extending spring arms 32*b*. Spring member 32 is placed over disc 30 with the distal free ends 32*c* of spring arms 32*b* engaging the bottom surface of insulating strip 16 to place a force on the outer peripheral portion of disc 30 to urge the disc into engagement with disc seat 20*b* even when thermostatic switch 10' is in an inverted or skewed orientation. This results in a more constant thermal response. The remainder of the switch, except for movable contact arm 22" which is modified so that sides 22*d"* extend downwardly, are the same as in the FIGS. 1–6 embodiment, and need not be re-described.

With respect to calibration, reference will be had to FIGS. 5 and 9*a*–9*d*. Initially, the position of motion transfer member 28 within aperture 22*b* and relative to disc seat 20*b* is such as to provide a gap $C_d$, a calibration distance (see FIGS. 5 and 9*a*) of approximately 0–0.2 mm between member 28 and $C_c$, a calibration level, the equivalent of a flat disc, in another words the distance between member 28 and a plane in which disc seat 20*b* lies plus the thickness of the disc. A tool in the form of a punch 40 has a first outer member 40*a* movable back and forth in a linear direction, i.e., vertically up and down as seen in FIGS. 9*a*–9*d*. Outer member 40*a* has a first plateau surface 40*b* having a configuration generally conforming to intermediate wall 20*d* of housing 20 and formed with a cylindrical cavity 40*c*. A second, cylindrical, inner member 40*d* is received in cavity 40*c* and is movable in the same linear direction. Second member 40*d* is provided with a radially extending flange 40*e* which is engageable with a stop surface 40*f* formed in first member 40*a* to limit outward movement of second member 40*d*. Second member 40*d* is spring biased against stop surface 40*f* by compression spring 40*g* which reacts against a base 40*h* of the punch. A pin 40*k* is centrally located and fixedly mounted in second member 40*d* and has a longitudinal axis which extends in a direction parallel with the linear direction of movement of the punch. The top portion 40*m* of pin 40*k* is precisely located relative to a raised annular surface 40*n* of the second member for a purpose to be described below. Annular surface 40*n* is configured to engage an annular portion of the bottom surface of housing 20 aligned with disc seat 20*b*.

Figure 9B:
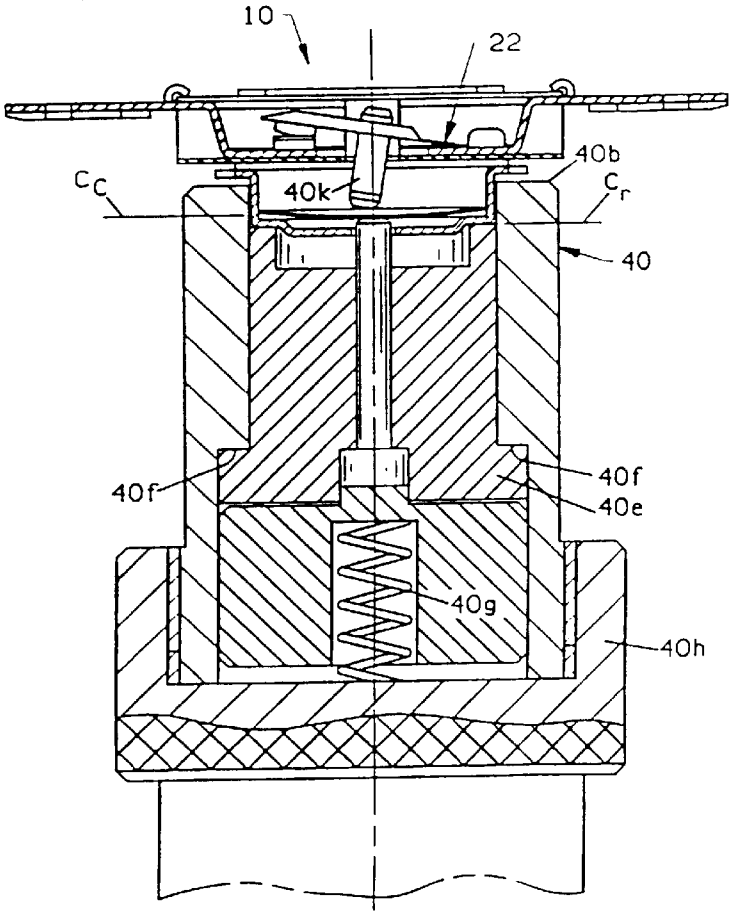
FIGS. 9*a*–9*d* are cross sectional views of a tool and a thermostatic switch, partially schematic, showing four different stages in calibrating the switch in accordance with the invention.
Figure 9A:
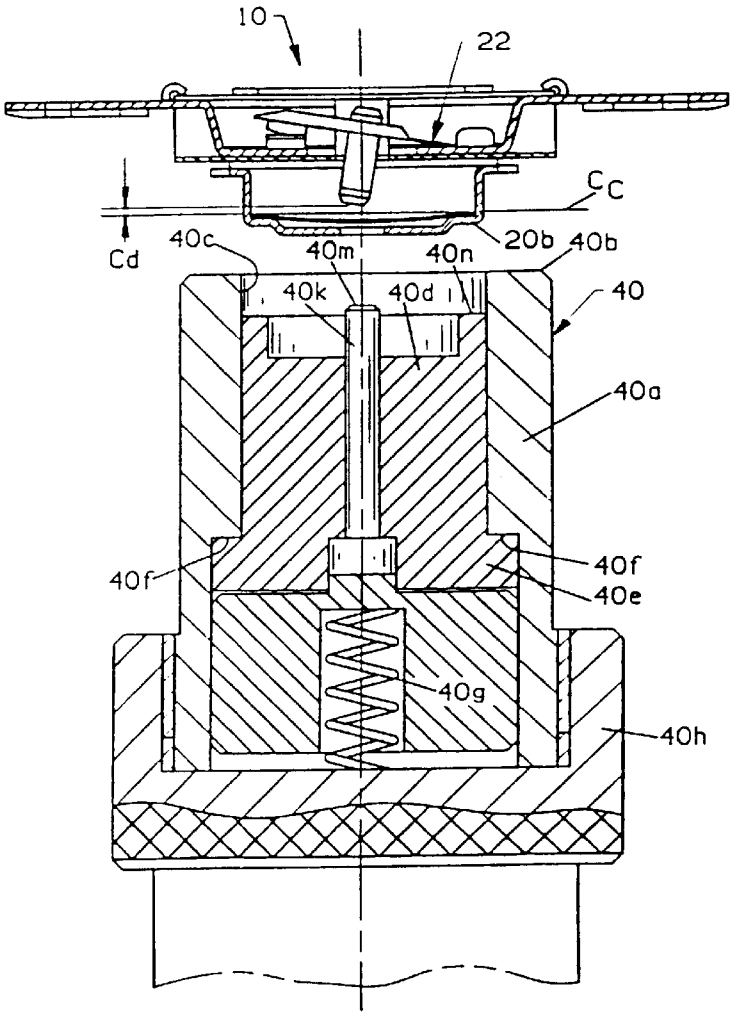

As seen in FIG. 9*b*, the punch is raised, relative to thermostat 10, so that annular surface 40*n* contacts an annular portion of the bottom wall 20*a* aligned with the disc seat 20*b* at a reference level $C_R$ and pin 40*k* is received through an aperture 20*h* in bottom wall 20*a* lifting the center of disc 30 to the calibration level $C_c$. At this step surface 40*b* of the first tool member has not yet engaged housing 20 and contacts 24, 26 are in engagement with one another.

Figure 9D:
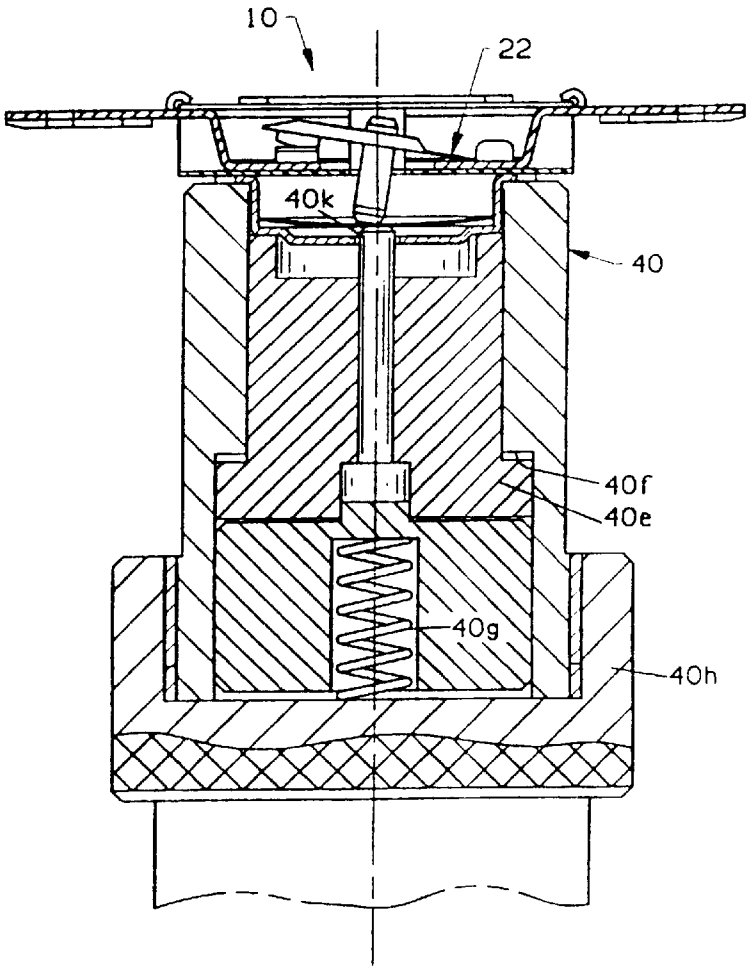
Figure 9C:
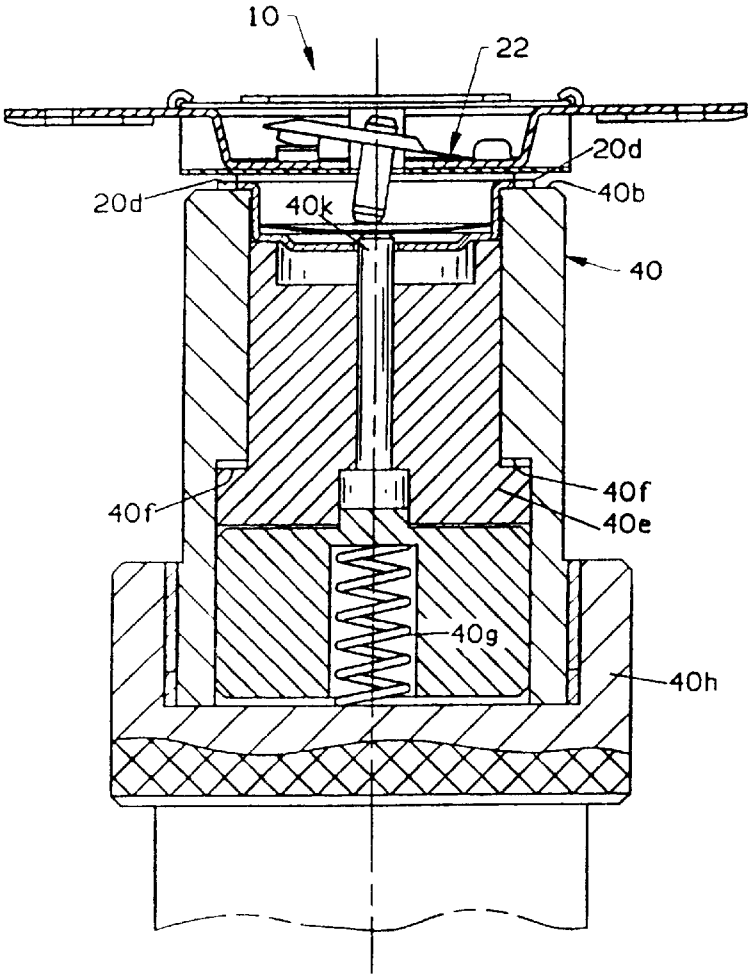

At the next step, FIG. 9*c*, surface 40*b* of the first outer member 40*a* engages housing 20 at intermediate wall 20*d*.

At the FIG. 9*d* step, punch 40 deforms the sidewalls of housing 20 until disc 30 engages motion transfer pin 28 and causes contacts 24, 26 to separate moving out of electrical engagement to complete the calibration procedure.

The distance between a reference level $C_R$, the level at which surface 40*b* engages can 20 and motion transfer member 28 includes the thickness of the material of housing 20 and disc 30 as well as the calibration distance $C_d$ and a certain amount for spring back.

In order to facilitate this procedure sidewalls 20*e* are preferably weakened, as by forming laterally extending slots 20*k*, to promote controlled buckling of sidewalls 20*e* at a selected location of the sidewalls during the calibration procedure. Further, sidewalls can be pre-bent a slight amount, i.e., 0.25 mm as indicated by dashed lines 20*m* in FIG. 5, to guide the buckling or bending motion in an inward direction.

Thermostats made in accordance with the invention eliminate the use of conventional ceramic or plastic housing members by permitting the use of stamped housing and insulating members to provide a lower cost device. It should be understood that although a preferred embodiment of the invention has been described by way of illustrating the invention, this invention includes all modifications and equivalents of the above described embodiment falling within the scope of the appended claims.

What is claimed:

1. A thermostat comprising a first and second electrically conductive terminal members having a terminal portion and a body portion, each body portion having a bottom wall, an end wall and opposed first and second sidewalls extending upwardly from the bottom wall to a top portion of the end wall and first and second sidewalls and a flange extending laterally outwardly from the top portion of the end wall and the first and second sidewalls of each terminal member, the terminal portion of each respective terminal member extending laterally outwardly from the flange at the respective end wall, a thermally conductive disc receiving housing member having a bottom wall formed with a generally annular disc receiving seat, opposed first and second sidewalls extending upwardly from the bottom wall on opposite sides of the disc receiving seat to respective first and second ledge portions, the flange of the first sidewall of each terminal member received on the first ledge portion and being spaced from one another and the flange of the second sidewall of each terminal member received on the second ledge portion and being spaced from one another with a strip of electrically insulating material interposed between the respective ledges and the flanges, the first and second housing member sidewalls each having a distal end portion bent over a respective flange and the strip of electrically insulative material to fixedly attach the housing member to the terminal members, the terminal members having tabs extending from the flange at each end wall bent over to engage the strip of electrically insulative material, a temperature responsive disc movable between oppositely dished configurations disposed on the disc receiving seat, a movable contact arm having opposed first and second end portions, one end portion of the movable contact arm cantilever mounted on the bottom wall of one terminal member, the other end of the movable contact being movable into and out of electrical engagement with the bottom wall of the other terminal member and being biased into engagement therewith and a motion transfer member extending from the movable contact arm toward the temperature responsive disc, the temperature responsive disc transferring motion to the movable contact arm through the motion transfer member to bias the movable arm out of engagement with the other terminal member when the temperature responsive disc moves to one of the dished configurations.

2. A thermostat according to claim 1 in which the movable contact arm is formed with an aperture therethrough intermediate to its first and second end portions and the motion transfer member is an electrically insulative pin received though the aperture in frictional engagement with the movable contact arm.

3. A thermostat according to claim 2 in which the aperture has a skirt portion depending therefrom to frictionally engage the electrically insulating pins.

4. A thermostat according to claim 2 in which the electrically insulative pin is composed of ceramic material.

5. A thermostat according to claim 1 in which the strip of electrically insulative material is formed of NOMEX.

6. A thermostat according to claim 1 in which the bottom wall of the thermally conductive disc receiving housing member is an end wall of a cylindrical section which extends upwardly for a selected distance to a location where the sidewalls are formed, each side wall formed with a weakened section to cause deformation of the sidewalls during calibration to occur at a selected location.

7. A thermostat according to claim 6 in which the weakened section is formed by at least one slot in each sidewall.

8. A thermostat according to claim 1 in which an aperture is formed in the bottom wall of the thermally conductive disc receiving housing member to facilitate calibration of the thermostat.

9. A thermostat according to claim 1 further comprising a spring member mounted in the thermally conductive housing member, the spring member placing a force on the thermally conductive disc toward the disc receiving seat.

10. A thermostat comprising first and second electrically conductive terminal members having a terminal portion and a body portion, each body portion having a bottom wall, an end wall and opposed first and second sidewalls extending upwardly from the bottom wall to a top portion of the end wall and first and second sidewalls and a flange extending laterally outwardly from the top portion of the first and second sidewalls of each terminal member, a thermally conductive disc receiving housing member having a bottom wall formed with a generally annular disc receiving seat, opposed first and second sidewalls extending upwardly from the bottom wall on opposite sides of the disc receiving seat to respective first and second ledge portions, the flange of the first sidewall of each terminal member received on the first ledge portion and being spaced from one another and the flange of the second sidewall of each terminal member received on the second ledge portion and being spaced from one another with a strip of electrically insulating material interposed between the respective ledges and the flanges, the first and second housing member sidewalls each having a distal end portion bent over a respective flange and the strip of electrically insulative material to fixedly attach the housing member to the terminal members, a temperature responsive disc movable between oppositely dished configurations disposed on the disc receiving seat, a movable contact arm having opposed first and second end portions, one end portion of the movable contact arm cantilever mounted on the bottom wall of one terminal member, the other end of the movable contact being movable into and out of electrical engagement with the bottom wall of the other terminal member and being biased into engagement therewith and a motion transfer member extending from the movable contact arm toward the temperature responsive disc, the temperature responsive disc transferring motion to the movable contact arm through the motion transfer member to bias the movable arm out of engagement with the other terminal member when the temperature responsive disc moves to one of the dished configurations.

11. A method for calibrating a temperature responsive thermostatic electric switch having a switch portion and a heat sensing portion, the heat sensing portion having a snap-acting temperature responsive disc disposed on a disc seat of a housing and movable between oppositely dished configurations in response to selected temperature conditions, the disc seat coupled to the switch portion through a pair of opposed sidewalls, the switch portion having a movable contact arm normally biased into electrical engagement with a stationary contact and a motion transfer member extending from the movable contact arm toward the top of the temperature responsive disc comprising the steps of adjusting the position of the motion transfer member relative to the movable contact arm to provide a selected gap between the motion transfer member and a plane lying parallel to and spaced above the disc seat by an amount equal to the thickness of the disc, providing a first member movable back and forth in a linear direction, the first member having a surface for engaging the housing on opposite sides of the disc seat, a spring loaded second member mounted on the first member movable with the first member and being movable in the linear direction relative to the first member, the second member having a surface for engaging the bottom surface of the housing aligned with the disc seat, the second member having a pin fixedly mounted relative to the second member, the pin being centrally disposed within the inner member and having a longitudinal axis extending parallel to the linear direction, moving the first and second members so that the second member engages the housing with the pin extending through an aperture in the housing, lifting the disc above the disc seat while leaving the first member spaced from the housing, moving the first member so that the surface of the first member engages the housing, moving the first member still further against the bias of the spring causing the sidewalls to deform until the movable contact arm moves out of electrical engagement with the stationary contact.

12. A method according to claim 11 in which the selected gap is between approximately 0 and 0.2 mm.

* * * * *